United States Patent [19]

Morin

[11] 4,380,145

[45] Apr. 19, 1983

[54] WIRE LINK-FORMING AND LINKING DEVICE

[76] Inventor: Robert A. Morin, 49 Mulberry Cir., Johnston, R.I. 02919

[21] Appl. No.: 236,620

[22] Filed: Feb. 20, 1981

Related U.S. Application Data

[63] Continuation-in-part of Ser. No. 65,941, Aug. 13, 1979, abandoned.

[51] Int. Cl.[3] ..... B21L 1/04

[52] U.S. Cl. ..... 59/27

[58] Field of Search ..... 59/27, 10, 12, 16, 18, 59/22, 23, 24, 25

[56] References Cited

U.S. PATENT DOCUMENTS

| | | | |
|---|---|---|---|
| 1,478,814 | 12/1923 | Bittrolf | 59/18 |
| 2,172,351 | 9/1939 | Kluley | 59/27 |
| 2,256,265 | 9/1941 | Morrow | 59/27 |
| 3,220,704 | 2/1962 | Stegmaier | 59/27 |
| 3,354,633 | 11/1967 | Crafford | 59/24 |
| 3,811,268 | 5/1974 | Rahn | 59/18 |
| 3,841,088 | 10/1974 | Crafford | 59/16 |

*Primary Examiner*—Gene Crosby

*Attorney, Agent, or Firm*—Barlow & Barlow, Ltd.

[57] ABSTRACT

An apparatus is disclosed for the feeding of oval-shaped open end wire links seriatim, from an open-link feeding bar magazine, to a groove in a movable link-forming slide tool. Subsequent upward movement of the link-forming slide tool carries the open oval-shaped wire link into internal surface contact with a fixed position link center-forming anvil. Closed chain links or findings are mounted over the ends of the open wire links at this point, and further upward movement of the link-forming slide tool results in the closure of the previously open wire link to a desired configuration such as oval or round, and its assembly with the preformed ornamental objects is completed. The present device may be employed in various power driven modes.

6 Claims, 9 Drawing Figures

WIRE LINK-FORMING AND LINKING DEVICE

CROSS-REFERENCE TO RELATED APPLICATIONS

This application is a continuation-in-part of my application Ser. No. 065,941 filed Aug. 13, 1979, now abandoned.

BACKGROUND OF THE INVENTION

The present invention relates to a machine for linking together several wire links or pieces of costume jewelry, and more particularly, to certain improvements in a machine for the handling and closing of open-end wire links, as for example, those customarily employed in the making of costume jewelry.

The open oval wire links consist of breeched wire oval-shaped wire links which are held loosely together on a bar form magazine arrangement, or by the use of a suitable cement or tape, and are readily removable from the feeding bar supply seriatim, to be later closed in order to join together two or more links or pieces of costume jewelry.

In certain operations it has been found that the cement used to join the individual open links seriatim in bar form interfered with the subsequent assembly processes to which the pieces were subjected. In the present invention this problem has been overcome and allows for the use of either cement or tape strips to hold together the open-ended oval wire links in the bar form feeding arrangement prior to their being fed into the process, or the links may be free of each other.

In prior link-forming machines, the closed link was created by a tool with a force applied from both the top of the open link as well as from the outside of the link by the shaping of two different parts as in U.S. Pat. No. 2,256,265. In the present invention, the link closing force is being applied from the region below the open link by the shaping of one sliding part, with the link that is in the process of being closed held at the interior surface of the link structure.

This novel application of the link-closing force in the present invention, i.e., from below the link, allows elimination of extraneous mechanical apparatus previously mounted above the link-forming operation area, resulting in increased operator speed, convenience, and efficiency, due to an improved link-forming and linking area, worker visibility and accessability.

Earlier link-closing devices resulted in jamming of the apparatus during the feeding of the open links from their magazine position. The present device has eliminated this difficulty by the carefully precise correspondence in thickness between the open, oval-shaped links and the thickness of the link-forming slide tool itself.

SUMMARY OF THE INVENTION

One object of the present invention is the provision of a machine for removing the open oval wire links from an open link-feeding bar seriatim, for subsequent feeding of the open links to a gripping means, and for finally closing the links as they are being held in said gripping means.

Another object of the present invention is to provide an improved arrangement for individually selecting the links one at a time and to maintain the alignment thereof during the link-feeding operation so as to minimize the danger of having the links jam the machine during its operating cycle.

Another object of the present invention is to simplify the number of steps in the wire link-closing operation.

Yet another object of the present invention is to remove machine-top mechanical obstructions, thereby allowing higher operator efficiency, speed of cycling, and safety, due to the improved working area visibility.

Still yet another object of the present invention is to provide for machining of a single rather than a plurality of parts for the link formation and thus, a simplified construction.

Another object of the present invention is to provide for a resultant perfectly circular closed wire link shape.

Finally another object of the present invention is to provide a device which may be used in various power driven modes, such as manual, pneumatic, hydraulic, or electrically-driven modes.

The various points of novelty which characterize this invention are pointed out with particularity in the claims annexed to and forming a part of this specification. For a better understanding of the invention, its operating advantages, and specific objects attained by its use, reference should be had to the accompanying drawings and descriptive matter in which is illustrated and described a preferred embodiment of the invention.

DESCRIPTION OF THE PREFERRED EMBODIMENT

Figure 1:
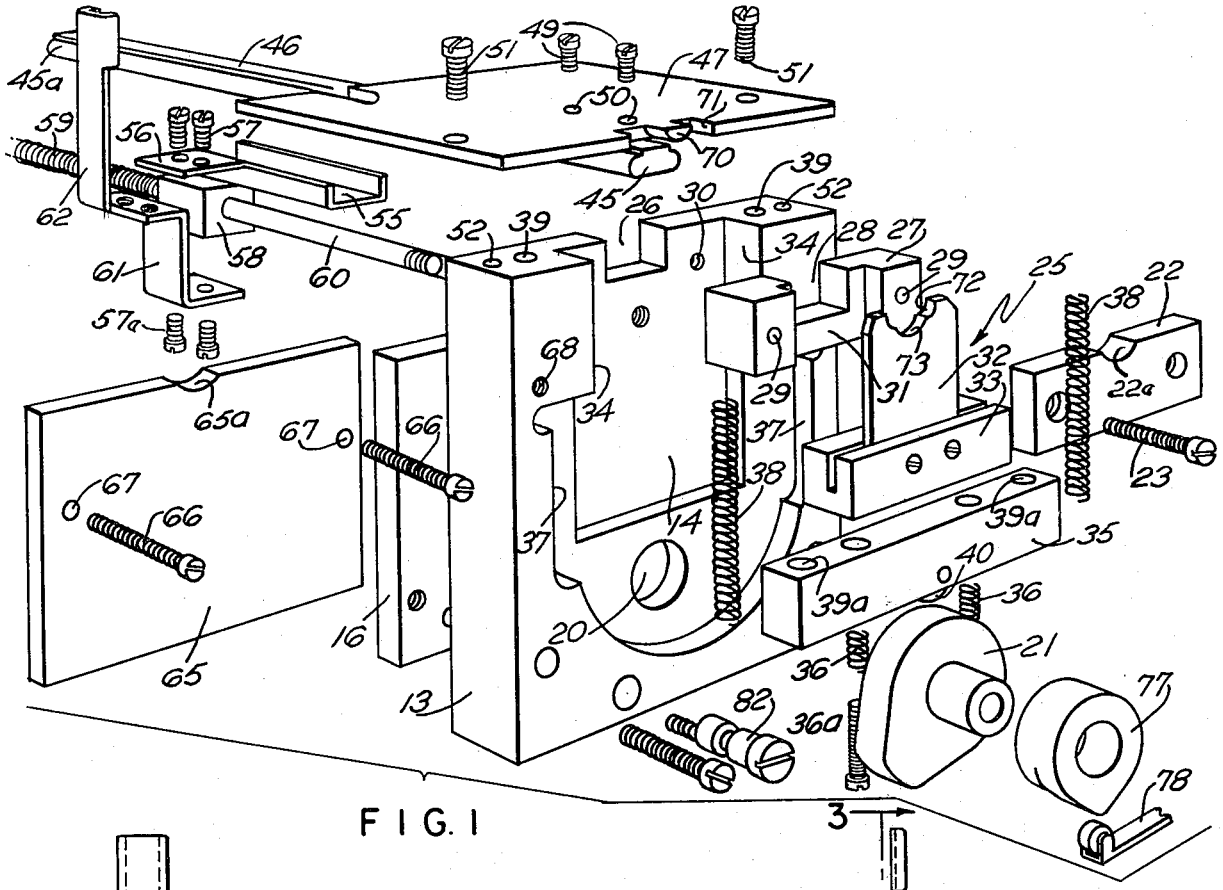
FIG. 1 is an exploded view of the linking apparatus of my invention.
Figure 3:
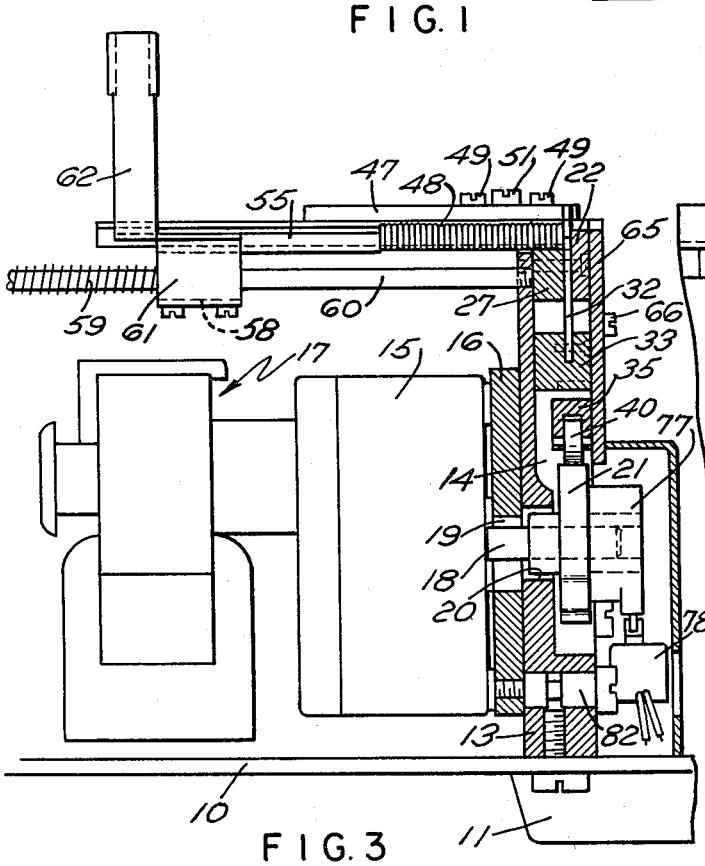
FIG. 3 is a substantially central longitudinal section of the apparatus taken on lines 3—3 of FIG. 2.
Figure 2:
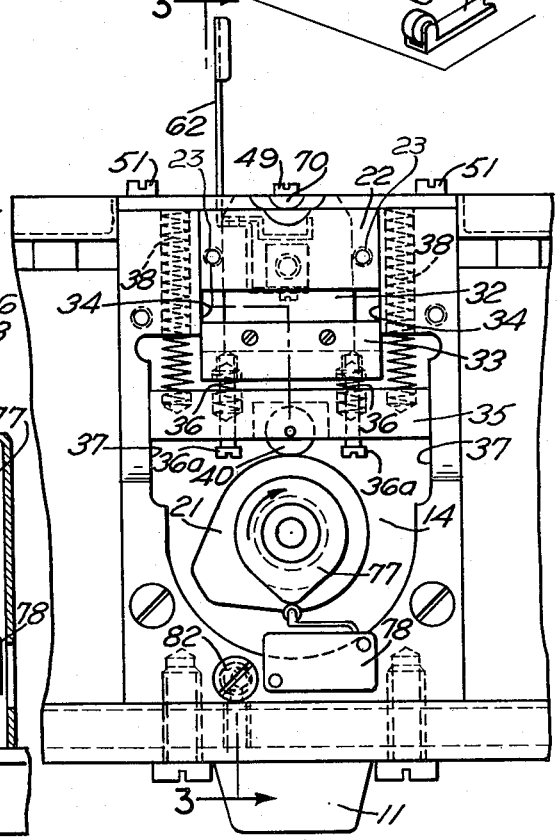
FIG. 2 is a fragmental end view of the apparatus shown in elevation.

Referring particularly to FIG. 3, the apparatus has a base 10 supported on feet 11. Fastened to this base is the body 13 of the machine which is recessed as at 14 for the reception of various operating parts. An electric motor 15 is mounted by means of plate 16 on the rear side of the body 13 and is equipped with a brake designated generally 17 for stopping the motor. The motor is preferably a gear motor having a low revolution output on shaft 18 which extends through opening 19 in the plate 16 and through opening 20 in the recessed portion of the body 13. This shaft 18 has affixed thereto a cam 21 that operates the link closing tool designated generally 25 which is located in the recessed portion 14 of the body.

At the upper end of recess 14, the body is notched as at 26 to provide clearance for the link bar. A guide member 27 having a notch 28 aligning with notch 26 is secured in the recess 14 of the body portion 13 by means of screws 23 passing through cover plate 22 and openings 29 that are threaded into openings 30 in the body portion 13. Member 27 is recessed as at 31 about the notch 28 and provides a slideway for slidably receiving and guiding the link closing tool 32. This tool is removably mounted in the upper portion 33 of a slide which is guided along the side walls 34 of the recessed portion 14. The upper portion 33 is loosely connected by cap screws 36*a* to a lower slide portion 35 while springs 36 urge the portions 33 and 35 (see FIG. 4). The portion 35 is guided in its vertical movement by engagement with the sides 37 of the recess 14, and is held in the slideway by a plate 65 secured across slideway 31 by cap screws 66 (see FIG. 3). This plate insures that tool 32 is retained in its slideway 31. Springs 38 extending through openings 39 in the body engage recesses 39*a* in the part 35 and urge it downwardly. These springs exert a force on the part 35 much greater than the force of springs 36. Cam 21 below the part 35 is engaged by a rotatable follower 40 to lift the link operating tool 32 upwardly for closing the link as will presently appear.

Open-ended links 48 are fed upon the end 45*a* of the oval bar 45 which has a raised portion 46 and is suspended from plate 47 so that the links 48 (see FIGS. 3 and 4) will freely slide along this feeding bar 45. The plate 47 is secured to the raised portion 46 of the bar by screws 49 through openings 50, while the plate itself is secured by screws 51 to the upper end of the body 13 by threading in two holes 52. This arrangement places the bar 45 in the aligned recesses 26 and 28 so that bar 45 leads to and directs links 48 to the slideway 31 for the tool 32.

Figure 5:
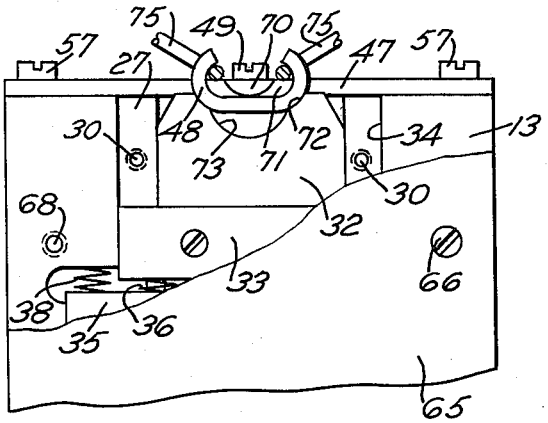
FIGS. 5, 6 and 7 are views of the upper portion of the link closing mechanism shown in various positions of movement from the open end position in FIG. 4 to the finish position in FIG. 7.
Figure 7:
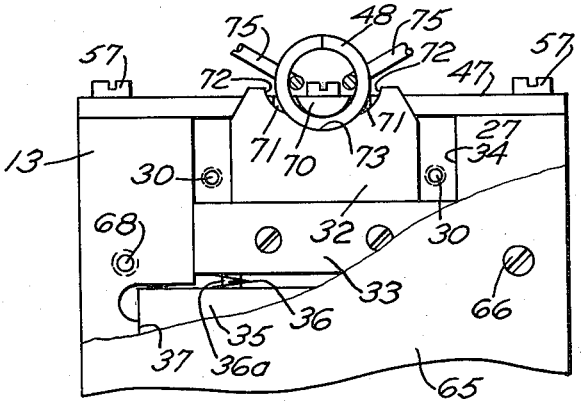

In order to feed the links 48 along the bar 45 there is a U-shaped pusher 55 which engages the rearmost link on the bar 45. This pusher 55 has a flange 56 secured by screws 57 to Z-shaped bracket 61 which in turn is fastened by screws 57*a* to block 58. The block 58 is urged by a helical spring 59, having a suitable abutment (not shown) to slide along rod 60 which is mounted in the body 13 and act as the force to urge the links forwardly in the machine. The Z-shaped bracket 61 mounts a handle 62 that extends upwardly so as to enable the block and its link pusher 55 to be moved rearwardly to an extent to expose the end 45*a* of the feeding bar 45 and allow additional links to be placed thereon. A front plate 65 is mounted by means of screws 66 through openings 67 into openings 68 to act as a closure and retainer for the link closing tool 25. Plate 22 serves as a stop to limit the forward movement of the links 48 (see FIG. 3) and yet permit discharge of a formed link such as the link shown in FIG. 7, as the cut-out 22*a* is formed to pass only a desired radius. When the link is discharged from the machine, the next adjacent link will be moved to engage the plate 22 and into the slot left by the removed link and will be located just above the link manipulating tool 32 and will be against the plate 22 of the machine to act as a stop for it. This is accomplished by the proper shaping and location of cut-out portions 22*a*, 65*a* in line with anvil 70. For example, as seen in FIG. 5, the lower corners of the link will positively engage the inner face of plate 22 until formed as seen in FIG. 7.

Figure 4:
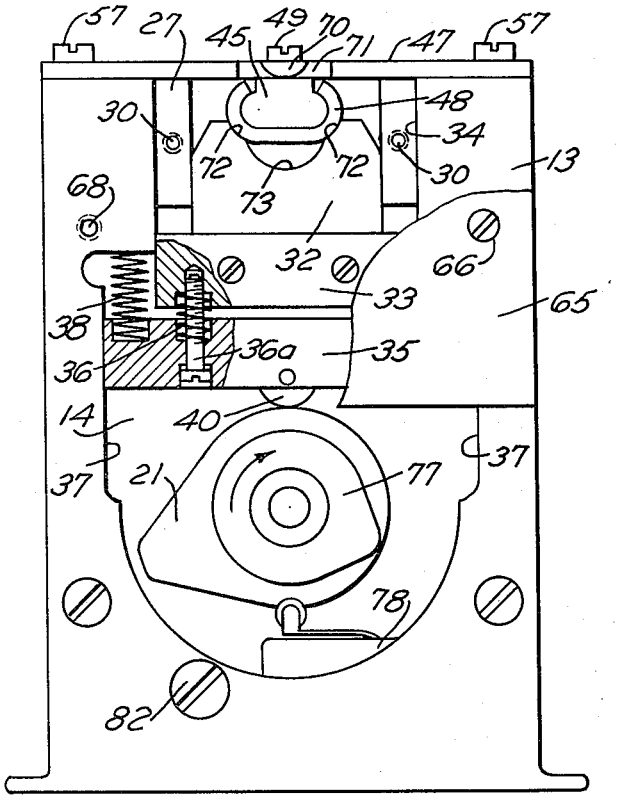
FIG. 4 is an elevational view along the lines of FIG. 2 with parts removed illustrating the cam in its lower position for raising the link operating tool.
Figure 6:
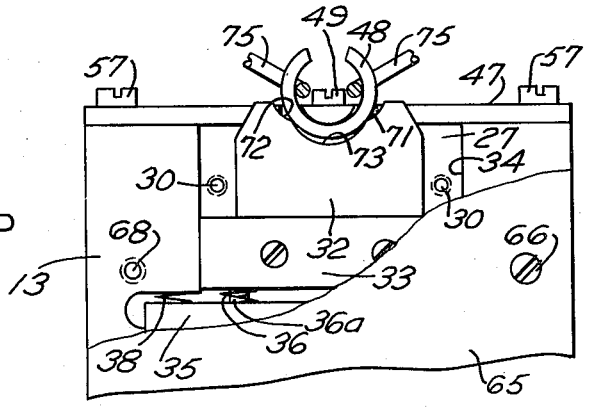
Figure 9:
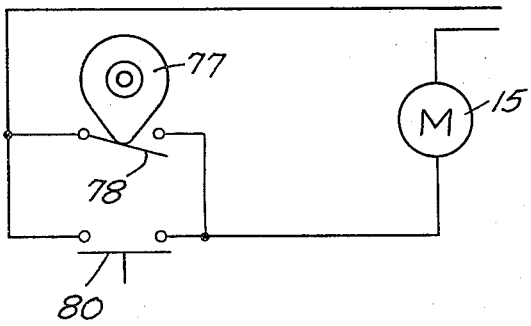
FIG. 9 is a simplified electrical schematic.

Top plate 47 will have a semi-circular anvil 70 or forming tool extending forwardly with recesses 71 on either side of it. Assuming the link has just been discharged, a link 48 will be fed forwardly to be stopped by plate 22 and will be moved into position in the slideway 31 left by the discharged closed link, to be in position to be engaged by the link operating tool 32 as seen in FIG. 4. This link will be located as shown in FIG. 4 in the arcuate portions 72 on either side of the central arcuate recess 73, the link being engaged at its curved portions as seen in FIG. 4 and also the link will be centralized below the anvil 70. At this point the tool 32 will be raised mechanically by the motor 15 and its cam 21 so as to raise the link so its inner surface will be against the anvil 70 with a "soft" or cushioned action in view of the springs 36 separating driven parts 33 from the drive part 35 where the tool will momentarily stop by the cam shape so that the operator may place over the open ends of the link the parts of the pieces of jewelry or the like 75 (see FIG. 6) to be attached together and then the cam will proceed to further raise the link 48 as now seen in FIG. 6 so that the arcuate portion 73 of the tool 32 will carry the link into further closing position as seen in FIG. 6 and finally into closed position as shown in FIG. 7, whereupon the completed link with additions will be removed from the machine. The tool 32 under urgance of springs 38 will be permitted to be lowered by the cam and a new link will be urged by spring 59 into the space in the slideway above the tool 32 and at the same time, a second cam 77 will open the switch 78 in the circuit to the motor 15 and the motor will come to rest by action of brake 17 ready for a new cycle to be performed which will be initiated by the foot switch 80 in the circuit shown in FIG. 8.

The cam has been described as being rotated by an electric gear motor 15. In this situation, the momentary actuation of the foot switch 80 closes the circuit to the motor and once the cam 77 rotates, switch 78 maintains a circuit until the cycle is completed. Similarly, a hydraulic motor would have an identical operation.

One of the unique features illustrated is the provision of a fine adjustment that will adapt the cam stroke to the linking operation. To accomplish this, an eccentric screw 82 is provided that will rock the body 13 relative to the cam 21. Once adjusted, body 13 and motor plate 16 fasteners will hold the apparatus in adjusted position.

Figure 8:
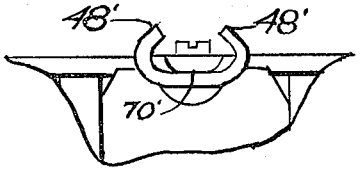
FIG. 8 is a diagramatic view illustrating the closing of an oval link.

Another unique feature of the invention lies in the ability to close links into an oval by merely changing the shape of the anvil to a shape as seen in FIG. 8. Here a flat bottom portion of anvil 70' and a flattening of the link blank at 48' are all that is required to form oval links, all in one device.

I claim:

1. A machine for closing open end links comprising a magazine having means for guiding the open end links; a slideway intersecting the path of said link guiding means;

a fixed semi-circularly shaped link center forming tool across said slideway on one side of the path of said link guiding means;

a single one-piece slide tool in said slideway on the other side of the path of said link guiding means having an irregularly-shaped groove having an upper arcuate portion mating with said link and supporting the link at spaced points at least for initial movement to the forming tool and a lower arcuate portion, the juncture of said portions defining spaced link contacting points whereby, when an open end curved link having a concave inner surface is moved into the path of said slideway and engaged by said upper arcuate spaced points of said slide tool and moved toward said center forming tool, its inner surface will first engage said center forming tool and further movement in the same direction of said slide tool with both arcuate portions will cause said spaced link contacting points to bend the link on either side of the center thereof about said center forming tool moving the link out of said upper arcuate portion and without interruption of bending into the lower arcuate portion to close the open ends of the link.

2. The apparatus of claim 1 wherein the finished links are round and wherein the lower arcuate portion will engage said link to further bend the link into circular shape closing the open ends of said link.

3. The apparatus of claim 1 wherein said open links are oval shaped in configuration.

4. The apparatus of claim 1 wherein the said open wire link inner surface contacts the lowest point of the semi-circularly shaped configuration of the said link center-forming tool in the link closing cycle.

5. The apparatus of claim 1 wherein said magazine comprises a link feeding bar the said open wire links are serially fed, one at a time, from the said link feeding bar to their resting position in the said irregularly-shaped groove of the said link-forming slide tool.

6. The apparatus of claim 1 and cam means to operate said slide tool through its motions.

* * * * *